US005823839A

United States Patent [19]

Khanamirian

[11] Patent Number: 5,823,839

[45] Date of Patent: Oct. 20, 1998

[54] PERSONAL FLOTATION DEVICE HAVING ELASTIC ARMHOLE PERIPHERY

[75] Inventor: Alexander Khanamirian, Miami Beach, Fla.

[73] Assignee: Extrasport, Inc., Miami, Fla.

[21] Appl. No.: 780,210

[22] Filed: Jan. 8, 1997

[51] Int. Cl.[6] ..... B63C 9/08

[52] U.S. Cl. ..... 441/106; 441/108; 441/115

[58] Field of Search ..... 441/59, 88, 106, 441/107, 108, 111, 113, 114, 115, 116, 117, 118, 119, 122

[56] References Cited

U.S. PATENT DOCUMENTS

| | | | |
|---|---|---|---|
| 1,514,435 | 11/1924 | Chatham . | |
| 1,837,089 | 12/1931 | Wosk . | |
| 2,226,564 | 12/1940 | Kienitz | 9/20 |
| 2,389,735 | 11/1945 | Morner | 441/115 |
| 3,646,626 | 3/1972 | Frieder | 9/342 |
| 3,681,799 | 8/1972 | Smith | 9/340 |
| 4,538,998 | 9/1985 | Holzel | 441/122 |
| 4,547,165 | 10/1985 | Scheurer et al. | 441/112 |
| 4,655,718 | 4/1987 | Lucius | 9/10 |
| 5,184,968 | 2/1993 | Michalochick et al. | 441/106 |
| 5,459,874 | 10/1995 | Meredith | 441/106 |

*Primary Examiner*—Stephen Avila
*Attorney, Agent, or Firm*—Sanford J. Asman

[57] ABSTRACT

A U.S. Coast Guard approved personal flotation device for persons engaged in sport activities. The personal flotation device includes a body formed from a series of body panels, or sections, formed from a fabric covered soft foam flotation material. Elastic armhole periphery members are attached about the armholes of the PFD intend to engage the shoulders and upper arms of the wearer. The armhole periphery members are formed from an elastic, stretchable material so as to enable the armhole periphery members to flex and conform to the shoulders and upper arms of the wearer as the arms, shoulders, and upper torso of the wearer move while the wearer performs water sport activities. This allows the PFD to move and conform to the body of the wearer for enhanced comfort and increased ability of the wearer.

7 Claims, 2 Drawing Sheets

PERSONAL FLOTATION DEVICE HAVING ELASTIC ARMHOLE PERIPHERY

FIELD OF THE INVENTION

The present invention relates generally to personal flotation devices. In particular, the present invention relates a personal flotation device having elastic armhole periphery members formed from an elastic, or stretchable, or flexible material which enables the personal flotation device to engage the arms of a wearer, and to flex and move with the arms, shoulders, and torso of the wearer, as the wearer engages in water sport activities. At the same time, the personal flotation device of the present invention provides enhanced flotation or buoyancy for the wearer, when the wearer is in the water.

BACKGROUND OF THE INVENTION

Personal flotation devices, or "PFDs", have evolved over the years from the old "Mae West", or kapok, type of life vests; then to vinyl covered foam rubber life jackets; and, finally, to more specialized flotation devices which are used for different types of water sports or boating activities. The U.S. Coast Guard has instituted regulations regarding the minimum flotation required of PFDs. As set forth in those regulations, the minimum flotation required depends upon the expected use of the PFD. The U.S. Coast Guard Regulations, Title 33 of the Code of Federal Regulations ("CFR"), Chapter 1, Part 175, Subpart B, require that recreational boats have at least one Coast Guard approved PFD on board for each person on a boat.

In recent years, safety concerns have increased, and, therefore, the Coast Guard Regulations regarding minimum flotation for PFDs have become stricter. Accordingly, PFDs are now segregated into different classes which depend upon the type of boating activity in which the PFD is intended to be used. Generally, there are five classes of PFDs. They are designated as Type 1, offshore life jacket; Type 2, near shore buoyant vest; Type 3, flotation aid; Type 4, throwable device; and Type 5, special use device. The Type 3 PFDs, or flotation aids, are generally the best suited for most recreational water sports in which a significant degree of mobility, and arm and shoulder movement, are involved. Accordingly, they tend to be the most common type of PFDs in use. The U.S. Coast Guard Regulations require that all Type 3 PFDs have a minimum of 15.5 pounds of flotation when they are manufactured. As most adults generally weigh between 10 and 12 pounds when submerged in water, i.e., significantly less than the minimum Coast Guard flotation requirement, the provision of at least 15.5 pounds of buoyancy is sufficient to insure that a person wearing such a PFD will have no problem floating.

In the past, increasing the buoyancy of PFDs has generally required that there be an associated increase in the bulk of the PFD, as additional buoyant material is required to increase a PFD's buoyancy. The addition of thicker and/or additional buoyant material to a PFD typically results in increased bulk which tends to inhibit or restrict the freedom of movement of the wearer. This restriction on the freedom of movement of the wearer is especially a problem for wearers involved in strenuous water sport activities which require a significant amount of movement of their arms, shoulders, and torso. By way of examples, in canoeing, kayaking, boating, wind surfing, or similar activities, significant arm, shoulder, and upper torso movement is required when the wearer is paddling or maneuvering sails and lines. In addition, most conventional PFDs do not tend to move with the wearer. Instead, they tend to ride up, or shift, on the wearer's torso, thereby making the PFD uncomfortable to wear and also interfering with the wearer's mobility.

As PFDs are more likely to be worn if they are comfortable, and as the mortality rate, due to drowning would be lower if PFDs were always worn, the provision of a comfortable PFD would assist in decreasing the mortality rate due to drowning. Accordingly, it can be seen that a need has existed for a PFD which flexes with, and conforms more naturally to, the arm, shoulder, and torso movement of a wearer, so that as the wearer moves, the PFD moves with the wearer. A PFD which moves with the wearer, rather than shifting, is far less likely to become uncomfortable for the wearer or to interfere with, or restrict, the movements of the wearer. At the same time, it would be desirable for such a PFD to provide enhanced flotation, so that it continues to meet or exceed U.S. Coast Guard Regulations for PFDs.

SUMMARY OF THE INVENTION

Briefly described, the present invention comprises a personal flotation device ("PFD") for use by persons engaged in water sports activities, including canoeing, kayaking, boating, wind surfing, and similar activities, which meets or exceeds U.S. Coast Guard regulations regarding flotation for PFDs while providing enhanced comfort and mobility to the wearer. The PFD of the present invention meets the foregoing objectives. It is comprised of a body, typically formed as a vest, which is adapted to fit over and about the torso of a wearer. The body of the PFD is comprised of a series of body panels, or sections. These panels include, but are not limited to, a pair of front panels, which have substantially vertical edges. The PFD further comprises a pair of side panels, each also having substantially vertical edges, whereby one edge of each front panel is attached to one edge of each side panel. The PFD further comprises at least one back panel which also has a pair of vertical edges, each of which is attached to the vertical edge of each of the side panels which is remote from the vertical edge connected of the side panel which is connected to the front panel to which that side panel is connected. Each of the body panels is typically formed from a buoyant flotation material, such as a closed cell polyvinylchloride ("PVC") foam material. The side panels are preferably covered by a durable fabric, and, in the preferred embodiment of the invention, the connection of the panels is made by sewing the respective fabric coverings over the panels . A zipper, or similar fastening or closure means, is preferably sewn to the free, exterior vertical edges of the front panels of the PFD's body, so that the PFD can be closed and fastened about the torso of the wearer, thereby securing the PFD about the upper torso of the wearer. Alternatively, the fastening or closure means could be comprised of at least one webbing belt, together with at least one associated buckle.

Armholes are defined in the body of the PFD between the upper portions of the front and side panels, and the upper side edges of the body panel. Elastic armhole periphery members are attached to the periphery of each armhole, thereby defining the armholes and providing an over the shoulder support which connects the front panels to the back panel. The elastic armhole periphery members are adapted to engage the shoulders and upper arms of a wearer, when the PFD is worn. The elastic armhole periphery members are generally formed from an elastic, stretchable, flexible material, such as neoprene, or a similar elasticized material. The elasticized armhole periphery members engage and conform to the arms and shoulders of a wearer. Thus, as the wearer moves his arms, shoulders, and upper torso, such as when he is paddling a canoe or a kayak, or engaged in sailing activities, the elastic armhole periphery members flex with the movements of the wearer, thereby enabling the PFD to conform to, and move with, the arms, shoulders, and upper torso of the wearer.

Various objects, features, and advantages of the present invention will become apparent to those skilled in the art upon reading the following detailed description of a preferred embodiment of the invention when taken in conjunction with the accompanying drawings.

DETAILED DESCRIPTION OF THE PREFERRED EMBODIMENT OF THE INVENTION

Figure 1:
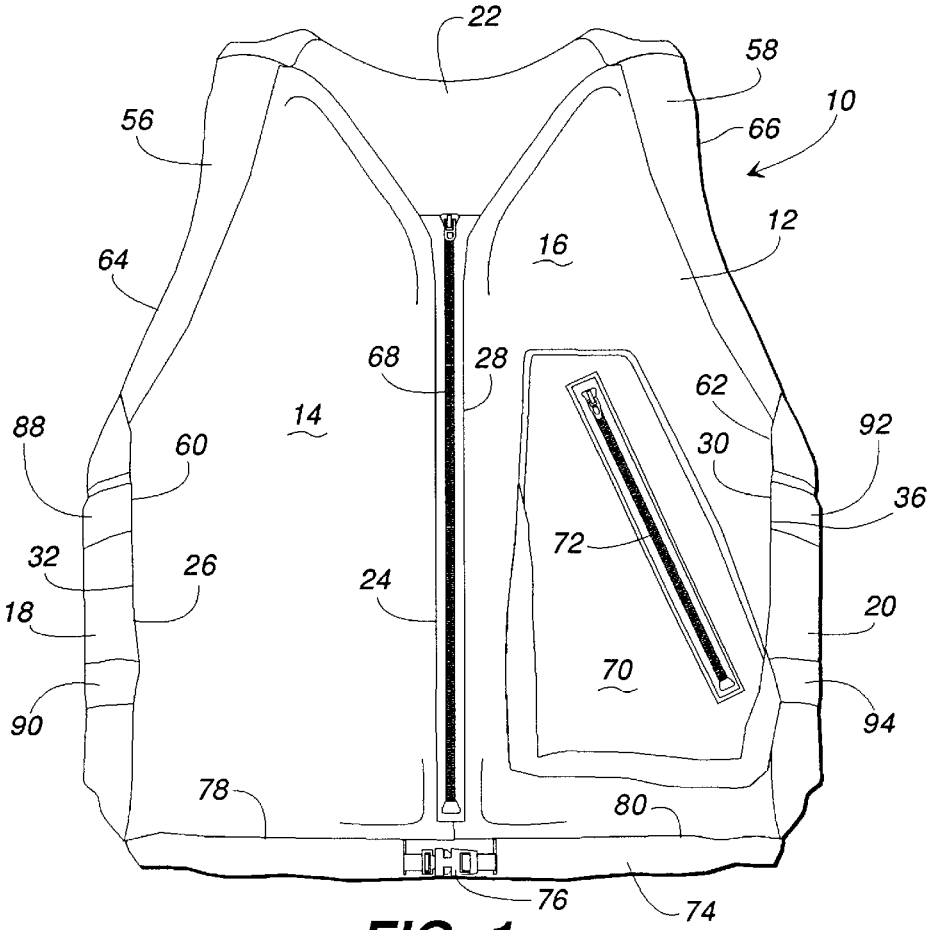
FIG. 1 is a front view of the PFD of the present invention.

Referring now to the drawing in which like numerals indicate like parts throughout the several views, FIG. 1 illustrates the personal flotation device, or PFD 10, of the present invention. The PFD 10 is designed for use by a wearer who is engaged in water sports, such as canoeing, kayaking, sea kayaking, boating, sailing, wind surfing, or similar water sport activities. The PFD 10 is designed as a vest 12 which is adapted to fit about the torso and shoulders of a wearer with the arms 24, 26 of the wearer extended therethrough, as shown in shadow in FIG. 3.

Figure 2:
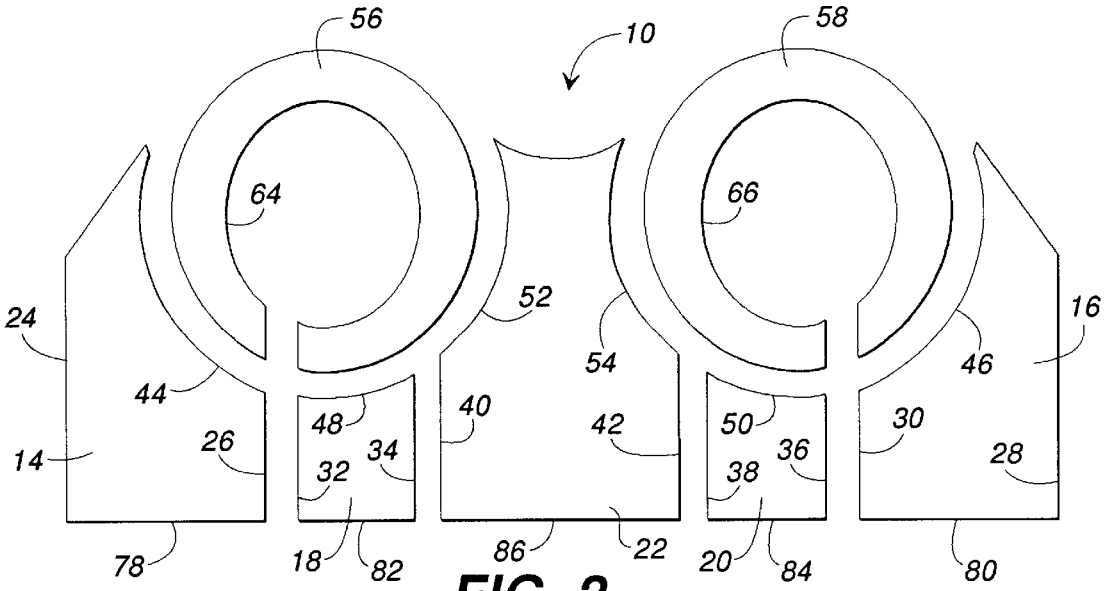
FIG. 2 is a back view of the PFD of FIG. 1 illustrating the manner in which the various sections of the PFD are assembled.

As shown in FIGS. 1 and 2, the PFD 10 includes a body 12 formed as a vest from a series of sections, or panels. In particular, there are a pair of front panels 14, 16; a pair of side panels 18, 20; and a back panel 22. Each of the body panels 14, 16, 18, 20, 22 is typically formed from a conventional flotation material, such as a closed cell PVC foam material. One such foam material is commonly sold under the trademark "AIREX". However, other, similar, flotation materials, such as ethyl vinyl acetate foam, which is soft and somewhat pliable, may also be used. In accordance with the invention, it is important that a material be selected which is both buoyant and flexible, and it is desirable for the material to be relatively thin. Other desirable features of the material from which the panels 14, 16, 18, 20, 22, are constructed are that the material should remain buoyant, notwithstanding it becoming wet, and it should not deteriorate over time with exposure to the elements. As is understood by those skilled in the art, there are a number of closed cell foam plastic materials, as well as other materials which meet these objectives, without departing from the present inventive concept, and which are able to provide buoyancy, without significant bulk or weight. Thus, by an appropriate selection of material, the body sections can be made thinner and lighter as desired, in order to provide a more narrow profile, while a soft foam material, such as "AIREX" enables the body sections 14, 16, 18, 20, 22 to closely conform to the wearer's body, without sacrificing either buoyancy or comfort.

In accordance with the invention, the flotation material of the body panels 14, 16, 18, 20, 22 is preferably covered with a durable fabric. In the preferred embodiment of the invention, a nylon material, such as a 200 denier nylon oxford fabric, is used, as it provides for strength, comfort, and water drainage. Those skilled in the art will, however, understand that other types of similar, durable fabric materials can be used without departing from the present invention.

As shown in FIG. 2, each of the front panels 14, 16 has a pair of substantially vertical, opposed edges 24, 26 and 28, 30, respectively. Similarly, the side panels 18, 20, which are substantially rectangular in shape, each have a pair of substantially vertical, opposed edges 32, 34 and 36, 38, respectively; and the back panel, which is somewhat "bottle" or "vase" shaped, also has a pair of substantially vertical, opposed edges 40, 42.

In the assembly of the PFD 10, the vertical edges 26, 32 and 30, 36 of adjacent front and side panels 14, 18 and 16, 20, respectively, are joined together. Also, the vertical edges 40, 42 of the back panel 22 are joined, respectively, to the adjacent, vertical edges 34, 38 of the adjacent side panels 18, 20. As illustrated in FIG. 2, the front panels 14, 16 each include a curved upper edge 44, 46, respectively, which is shaped to meet the curved upper edges 48, 50, respectively, of the adjacent side panels 18, 20. Similarly, the curved upper edges 48, 50 of the side panels 18, 20, meet with, and join, the curved side edges 52, 54 of the back panel 22. As illustrated in the drawing, particularly in FIG. 1, the respective curved edges 44, 48, 52, and 46, 50, 54, preferably meet to form a portion of the circumference of a circle. Accordingly, when the panels 14, 16, 18, 20, 22 are joined together, a pair of elastic armhole periphery members 56, 58 can be joined to the curved edges 44, 48, 52 and 46, 50, 54, respectively, thereby forming a vest.

In accordance with the invention, the panels 14, 16, 18, 20, 22, are covered by a suitable material, such as the 200 denier nylon oxford shell fabric, used in the present invention, whereby strength, comfort, and drainage, are provided. The fabric covered panels 14, 16, 18, 20, 22 are joined together, as described above, preferably by a series of seams, such as the seam 60, joining the edges 26, 32 of the panels 14, 18, or the seam 62, joining the edges 30, 36 of the panels 16, 20, which are lap-felled seams in the preferred embodiment of the PFD 10. As is understood by those skilled in the art, a lap-felled seam is a sewed seam in which the adjacent edges of the body panels are overlapped and folded. They are then preferably sewn together along their entire length using double rows of lock stitching to provide for extra strength and security.

Figure 3:
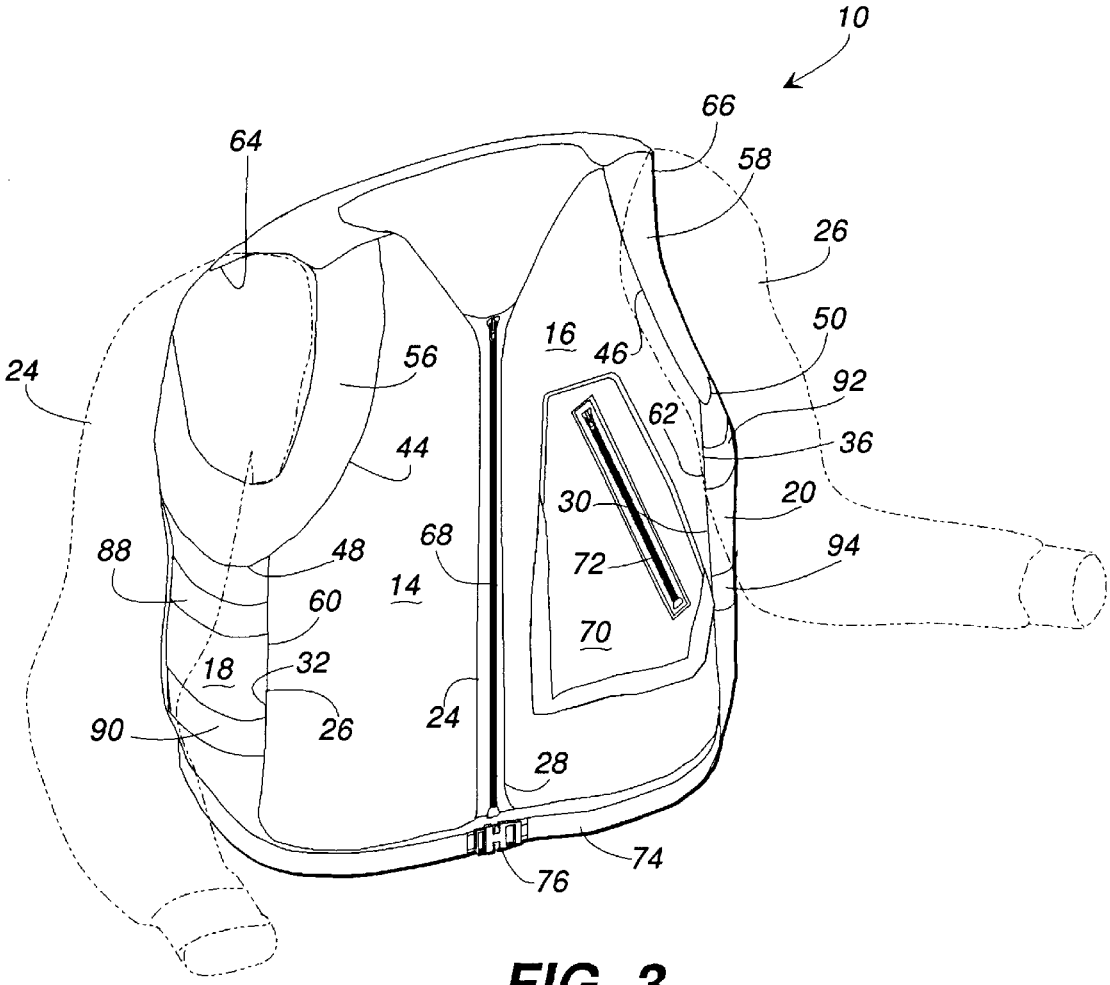
FIG. 3 is perspective view showing the PFD, illustrating the manner in which the PFD is worn by a wearer (shown in shadow).

As described above, the curved upper edges 44, 46, 48, 50 of the front and side panels 14, 16, and the curved side edges 52, 54 of the back panel 22, together with the elastic armhole periphery members 56, 58 define a pair of substantially circularly shaped armholes 64, 66 in the body of the PFD 10 through which the arms of a wearer are adapted to be received, as illustrated in FIGS. 2 and 3. In accordance with the present invention, the elastic armhole periphery members 56, 58, are constructed of a soft, flexible, elastic material, such as the Neoprene, or a similar polychloroprene material, which is used in the preferred embodiment of the invention, although those skilled in the art will recognize that other materials which provide similar properties could also be used without departing from the inventive concept. As illustrated in FIGS. 1–3, the elastic armhole periphery members 56, 58 are attached to the edges 44, 48, 52 and 46, 50, 54, of the body panels 14, 18, 22, and 16, 20, 22, respectively.

As shown in FIGS. 1 and 2, each of the elastic armhole periphery members 56, 58 is generally formed as a substantially circular strip of Neoprene or similar material, and they form the circular armholes 64, 66 of the PFD 10, protruding slightly outwardly from the body portion of the PFD 10 formed by the panels 14, 16, 18, 20, 22. The elastic armhole periphery members 64, 66 are adapted to engage the shoulders and upper arms of a wearer so as to hold the PFD 10 about the shoulders and upper arms of a wearer to thereby assist in preventing the PFD 10 from shifting or riding up on the wearer as the wearer moves.

As FIGS. 1 and 3 illustrate, a fastening means, typically a zipper 68, is attached to the exterior side edges 24, 28 of the front panels 14, 16. The zipper 68, which is a #10 YKK zipper in the preferred embodiment of the invention, is used to secure the PFD 10 on the torso of a wearer. It will be understood that other fastening means such as snaps, buckles, hook and loop fasteners, or similar attachment devices can be used without departing from the present inventive concept. In the preferred embodiment of the invention, a pocket 70 is preferably formed on the front surface of one of the front panels 16 of the PFD 10. The pocket 44 is preferably formed of a flexible, stretchable material such as a mesh fabric or Neoprene, and it preferably includes a zipper closure 72, which is also a #10 YKK zipper in the preferred embodiment of the invention.

With reference to FIGS. 1 and 3, the PFD 10 of the presendt invention further comprises a nylon adjustable webbing belt 74 which is designed encircle the bottom portion of the PFD 10 and to be buckled around the wearer using buckle 76. As shown, the webbing belt 74 is attached to the lower edges 78, 80, 82, 84, 86 of the panels 14, 16, 18, 20, 22.

In addition, there are, in the preferred embodiment of the PFD 10, four nylon side adjustment belts 88, 90, 92, 94, which are attached to the side panels 18, 20, are used in the preferred embodiment of the invention. The various belts 74, 88, 90, 92, 94 include adjustment means, for adjusting their lengths in order to properly size the PFD 10 to the torso of the wearer. Those skilled in the art will recognize that a different number of adjustment belts, or a zipper, with or without adjustment belts, could be substituted for the adjustment belts 88, 90, 92, 94, without departing from the inventive concept described herein.

As described herein, the PFD 10 of the preferred embodiment of the present invention, is a very comfortable design which combines the comfort of Neoprene with the benefits of soft, yet highly buoyant Airex foam flotation, to provide a very comfortable, efficient PFD which has a wide fit range due to the various adjustable webbing straps. As such, the PFD 10 will not only meet, but exceed all flotation requirements or standards set by the aforementioned U.S. Coast Guard Regulations.

It will be understood by those skilled in the art that although the present invention has been described above with reference to the preferred embodiment. Nevertheless, various modifications, additions and changes can be made thereto without departing from the spirit and scope of the invention as set forth in the following claims. Without limiting the types of changes which could be made without departing from the spirit or scope of the invention, a number of such changes are clearly contemplated. For example, it is possible to use more than one back panel 22. Further, while many of the foam panels in the preferred embodiment of the invention were described as having curved upper edges 48, 50 or curved side edges 52, 54, such edges could be horizontal or vertical, with suitable changes to the shape of the panels 18, 20, 22.

Also, while the in the preferred embodiment of the invention, the assembly was accomplished by using lap-felled sewed seams, those skilled in the art will recognize that other assembly methods, including radio welding, or vacuum forming, could also be used.

In addition, the use of Neoprene in the preferred embodiment of the invention, should not be construed as limiting, as other suitable materials, including Lycra (a synthetic fiber produced by E.I. DuPont de Nemours and Company, Wilmington, Del.), Darlexx (an elastic fabric produced by Darlington Fabrics Corporation, New York, N.Y.), or other stretch materials, would be within the intended scope of the invention.

While the present disclosure has related to traditional PFDs, those skilled in the art recognize that the present invention could be used on floating body suits, as well as traditional PFDs. Accordingly, it is intended that the term "personal flotation device", as used in the appended claims should be inclusive of both traditional PFDs as well as floating body suits.

I claim:

1. A personal flotation device adapted to fit about the torso, shoulders, and arms of a wearer to provide buoyancy and support for the wearer while the wearer is in water, while enabling a wide range of freedom of movement, comprising:

(a) a body formed from a series of body panels connected in series, each of said body panels being formed from a buoyant material; and (b) a pair of armhole periphery members, each of said armhole periphery members being formed solely of an elastic material which is located between adjacent ones of said body panels, said adjacent body panels not encircling the armhole periphery, while said armhole periphery members are adapted to encircle and engage the shoulders of a wearer with the arms of the wearer received therethrough.

2. The personal flotation device of claim 1 wherein said pair of armhole periphery members are each formed solely from a single piece of flexible, stretchable material to enable the personal flotation device to conform to, and move with, the wearer to provide enhanced comfort and effective buoyancy for the wearer, while enabling enhanced freedom of movement for the wearer.

3. The personal flotation device of claim 2 wherein said elastic armhole periphery members comprise substantially circularly shaped members formed from an elastic material.

4. The personal flotation device of claim 3 wherein said elastic material is selected from the group consisting of Neoprene, Lycra, and Darlexx.

5. The personal flotation device of claim 1 and wherein said body panels include a pair of side panels, a pair of front panels, and a back panel.

6. The personal flotation device of claim 1 and wherein said armhole periphery members are formed from a synthetic material.

7. The personal flotation device of claim 6 and wherein said synthetic material is selected from the group consisting of Neoprene, Lycra, and Darlexx.

* * * * *